US009068301B2

(12) United States Patent
Fielder

(10) Patent No.: US 9,068,301 B2
(45) Date of Patent: Jun. 30, 2015

(54) SINGLE TO DUAL STICK TROWEL AND STEERING CONVERSION

(71) Applicant: Allen Engineering Corporation, Paragould, AR (US)

(72) Inventor: Jeffrey Lynn Fielder, Bono, AR (US)

(73) Assignee: Allen Engineering Corporation, Paragould, AR (US)

( * ) Notice: Subject to any disclaimer, the term of this patent is extended or adjusted under 35 U.S.C. 154(b) by 0 days.

(21) Appl. No.: 14/497,990

(22) Filed: Sep. 26, 2014

(65) Prior Publication Data

US 2015/0093195 A1 Apr. 2, 2015

Related U.S. Application Data

(60) Provisional application No. 61/885,061, filed on Oct. 1, 2013.

(51) Int. Cl.
*E01C 19/42* (2006.01)
*B62D 7/16* (2006.01)

(52) U.S. Cl.
CPC ..... *E01C 19/42* (2013.01)

(58) Field of Classification Search
USPC ..... 180/6.24, 6.26, 6.32; 404/112
IPC ..... E01C 19/22,19/30, 19/42; B62D 3/02, B62D 11/006, 11/02, 7/16
See application file for complete search history.

(56) References Cited

U.S. PATENT DOCUMENTS

| | | | |
|---|---|---|---|
| 2,599,330 | A | 6/1952 | Jackson |
| 2,869,442 | A | 1/1959 | Mincher |
| 2,898,826 | A | 8/1959 | Livermont |
| 2,983,203 | A | 5/1961 | Fletcher |
| 3,095,789 | A | 7/1963 | Melvin |
| 3,110,234 | A | 11/1963 | Oster |
| 3,113,494 | A | 12/1963 | Barnes |
| 3,220,322 | A | 11/1965 | Lewis |

(Continued)

FOREIGN PATENT DOCUMENTS

| | | |
|---|---|---|
| CA | 990565 | 6/1978 |
| EP | 517579 | 12/1992 |

(Continued)

OTHER PUBLICATIONS www.polaris.com—Drive Train,Main Gearcase Internals of a CVT Clutch Module—Model R13TH.

*Primary Examiner* — Gary Hartmann
(74) *Attorney, Agent, or Firm* — Stephen D. Carver

(57) ABSTRACT

A dual rotor, manually steered riding trowel comprises powered, downwardly projecting rotors driven by reduction gear boxes that are tilted by parallel levers beneath the machine. A pair of vertical hand steering levers actuate the parallel levers to tilt the rotors. Each rotor may be swiveled in an arc parallel with the biaxial plane to produce pivoted fore and aft trowel movement. At least one rotor responds to lateral movements of one or both steering levers by tilting in an arc perpendicular to the biaxial plane, moving the trowel left or right. To emulate prior Allen trowels, lateral movements of one of the hand levers is mechanically disabled with a transformation link anchored to the frame. The transformation link may be disconnected from the frame and instead connected to the foot of the companion hand steering lever, allowing both steering levers to pivot laterally, resulting in a different steering "feel."

5 Claims, 5 Drawing Sheets

(56) References Cited

U.S. PATENT DOCUMENTS

| | | | | |
|---|---|---|---|---|
| 3,299,786 | A | 1/1967 | Godbersen | |
| 3,377,933 | A | 4/1968 | Dale | |
| 3,412,657 | A | 11/1968 | Colizza | |
| 3,450,011 | A | 6/1969 | Godbersen | |
| 3,541,931 | A | 11/1970 | Godbersen | |
| 3,572,227 | A | 3/1971 | Paulsen | |
| RE28,561 | E | 9/1975 | Stephens | |
| 3,936,212 | A | 2/1976 | Holz, Sr. | |
| 3,973,857 | A | 8/1976 | Whiteman, Jr. | |
| 4,027,991 | A | 6/1977 | Maass | |
| 4,046,483 | A | 9/1977 | Sutherland | |
| 4,046,484 | A | 9/1977 | Holz, Sr. | |
| 4,198,178 | A | 4/1980 | Carlstrom | |
| 4,232,980 | A | 11/1980 | Tertinek | |
| 4,312,603 | A | 1/1982 | Whiteman, Jr. | |
| 4,320,986 | A | 3/1982 | Morrison | |
| 4,388,017 | A | 6/1983 | Morrison | |
| 4,556,339 | A | 12/1985 | Morrison | |
| 4,577,993 | A | 3/1986 | Allen | |
| 4,629,359 | A | 12/1986 | Sengupta | |
| 4,673,311 | A | 6/1987 | Whiteman, Jr. | |
| 4,676,691 | A | 6/1987 | Morrison | |
| 4,710,055 | A | 12/1987 | Maass | |
| 4,752,154 | A | 6/1988 | Valentine | |
| 4,775,306 | A | 10/1988 | Kikuchi | |
| 4,784,519 | A | 11/1988 | Artzberger | |
| 4,859,114 | A | 8/1989 | Artzberger | |
| 4,977,928 | A | 12/1990 | Smith | |
| D323,510 | S | 1/1992 | Allen | |
| 5,108,220 | A | 4/1992 | Allen | |
| 5,129,708 | A | 7/1992 | Swan | |
| 5,190,401 | A | 3/1993 | Wilson | |
| 5,221,156 | A | 6/1993 | Martin | |
| 5,238,323 | A | 8/1993 | Allen | |
| D340,340 | S | 10/1993 | Allen | |
| D344,736 | S | 3/1994 | Allen | |
| 5,377,774 | A | 1/1995 | Lohr | |
| 5,405,216 | A | 4/1995 | Allen | |
| 5,476,342 | A | 12/1995 | Allen | |
| 5,480,257 | A | 1/1996 | Allen | |
| 5,480,258 | A | 1/1996 | Allen | |
| 5,533,830 | A | 7/1996 | Barichello | |
| 5,533,831 | A | 7/1996 | Allen | |
| 5,584,598 | A | 12/1996 | Watanabe | |
| 5,613,801 | A * | 3/1997 | Allen | 404/112 |
| 5,658,089 | A | 8/1997 | Allen | |
| 5,685,667 | A | 11/1997 | Allen | |
| 5,690,567 | A | 11/1997 | DeNijs | |
| 5,803,658 | A | 9/1998 | Allen | |
| 5,816,739 | A | 10/1998 | Allen | |
| 5,816,740 | A | 10/1998 | Jaskowiak | |
| D400,542 | S | 11/1998 | Allen | |
| D400,544 | S | 11/1998 | Allen | |
| D402,998 | S | 12/1998 | Allen | |
| D402,999 | S | 12/1998 | Allen | |
| D403,332 | S | 12/1998 | Allen | |
| D404,041 | S | 1/1999 | Allen | |
| 5,890,833 | A | 4/1999 | Allen | |
| D410,931 | S | 6/1999 | Allen | |
| D413,127 | S | 8/1999 | Allen | |
| 5,934,823 | A | 8/1999 | Allen | |
| 5,967,696 | A | 10/1999 | Allen | |
| D416,564 | S | 11/1999 | Allen | |
| 5,988,938 | A | 11/1999 | Allen | |
| 6,019,545 | A | 2/2000 | Allen | |
| 6,048,130 | A | 4/2000 | Allen | |
| 6,053,660 | A | 4/2000 | Allen | |
| 6,089,786 | A | 7/2000 | Allen | |
| 6,089,787 | A | 7/2000 | Allen | |
| 6,106,193 | A | 8/2000 | Allen | |
| 6,120,399 | A | 9/2000 | Okeson | |
| 6,155,940 | A | 12/2000 | Tempelton | |
| 6,250,844 | B1 * | 6/2001 | Sartler et al. | 404/112 |
| D453,344 | S | 2/2002 | Smith | |
| D465,897 | S | 11/2002 | Smith | |
| D466,909 | S * | 12/2002 | Allen et al. | D15/10 |
| D474,203 | S * | 5/2003 | Allen et al. | D15/10 |
| 6,569,043 | B2 | 5/2003 | Youngren | |
| 6,582,153 | B1 * | 6/2003 | Allen et al. | 404/112 |
| 6,857,815 | B2 | 2/2005 | Allen | |
| 6,953,400 | B2 | 10/2005 | Kalies | |
| 6,958,025 | B2 | 10/2005 | Huddleston | |
| 6,988,851 | B2 | 1/2006 | Sina | |
| 6,994,643 | B2 | 2/2006 | Kalies | |
| 7,063,633 | B2 | 6/2006 | Robert | |
| 7,081,057 | B2 | 7/2006 | Kalies | |
| 7,090,600 | B2 | 8/2006 | Lohr | |
| 7,104,725 | B1 | 9/2006 | Kipp | |
| 7,114,876 | B1 | 10/2006 | Allen | |
| 7,775,740 | B2 * | 8/2010 | Berritta | 404/112 |
| 7,927,241 | B2 | 4/2011 | Labbe | |
| 8,132,983 | B2 * | 3/2012 | Lutz et al. | 404/112 |
| 8,317,477 | B2 * | 11/2012 | Julius | 416/120 |
| 8,360,680 | B2 | 1/2013 | Allen | |
| 8,511,934 | B1 | 8/2013 | Paske | |
| 8,668,607 | B2 | 3/2014 | Brind'Amour | |
| 8,682,549 | B2 | 3/2014 | Roberge | |
| 8,684,886 | B2 | 4/2014 | Roberge | |

FOREIGN PATENT DOCUMENTS

| | | |
|---|---|---|
| GB | 2224057 | 4/1990 |
| SU | 185284 | 9/1966 |

* cited by examiner

SINGLE TO DUAL STICK TROWEL AND STEERING CONVERSION

CROSS REFERENCE TO RELATED APPLICATION

This utility patent application is based upon, and claims filing date priority from, a prior U.S. Provisional Patent application entitled "Single To Dual Stick Trowel Steering Conversion," by inventor Jeffrey Lynn Fielder, App. No. 61/885,061; Filed Oct. 1, 2013, which is hereby incorporated by reference as if fully set forth herein.

BACKGROUND OF THE INVENTION

I. Field of the Invention

The present invention relates generally to power riding trowels for finishing concrete that are equipped with manual steering. More particularly, the present invention relates to motor powered riding trowels of the type classified in United States Patent Class 404, Subclass 112, and to manual steering levers and linkages associated with such trowels.

II. Description of the Prior Art

It has long been recognized by those skilled in the art that freshly placed concrete must be appropriately finished. Proper and timely finishing insures that desired surface characteristics including appropriate smoothness and flatness are achieved. Motorized riding trowels are ideal for finishing large areas of plastic concrete quickly and efficiently, and such trowels have become a standard in the industry.

A typical power riding trowel comprises two or more bladed rotors that project downwardly from the frame and frictionally contact the concrete surface below for finishing. The rotors are driven by one or more motors mounted on the frame. Typically the motors drive suitable reduction gearboxes (i.e., 20:1 reduction) to power the twin rotors. The riding trowel operator sits on top of the frame and controls trowel movement with a steering system that tilts the axis of rotation of the gearboxes and the rotors. The weight of the trowel is transmitted frictionally to the concrete by the revolving blades. The unbalanced frictional forces caused by rotor tilting facilitate various trowel displacements, ultimately enabling steering and propulsion.

In a typical twin rotor design, each of the twin gearboxes has an axis of rotation that is generally perpendicular to the concrete surface over which the trowel moves. Each axis of rotation occupies a so-called "biaxial" plane that is perpendicular to the concrete surface. For steering and propulsion, both rotors are tilted by the steering linkage. Normally, twin vertically oriented steering levers in front of the seated operator are used to control steering. These steering levers run a pair of parallel, tilting levers beneath the trowel frame that tilt the gearboxes for steering. As explained in the numerous prior art references below, when the rotors are tilted such that they move in an arc that is coincident with or parallel to the biaxial plane, trowel weight is concentrated generally on the left or right periphery of the various rotors (i.e., the finishing blades) contacting the concrete, and the trowel moves forwardly or backwardly, or it can rotate, etc. To move left or right, at least one of the gearboxes is tilted through an arc that is generally perpendicular to the biaxial plane, concentrating weight on the front or rear periphery of at least one rotor, moving the trowel left or right.

Holz, in U.S. Pat. No. 4,046,484 shows a pioneer, twin rotor, self propelled riding trowel with manual steering. U.S. Pat. No. 3,936,212, also issued to Holz, shows a three rotor riding trowel powered by a single motor. The designs depicted in the latter two Holz patents were pioneers in the riding trowel art.

Prior U.S. Pat. No. 5,108,220 owned by Allen Engineering Corporation, the same assignee as in this case, relates to an improved manually steered riding trowel. Its steering system enhances riding trowel maneuverability and control. The latter fast steering riding trowel is also the subject of U.S. Pat. No. Des. 323,510 owned by Allen Engineering Corporation.

U.S. Pat. No. 5,613,801 issued Mar. 25, 1997 to Allen Engineering Corporation discloses a power riding trowel equipped with twin motors. The latter design employs a separate motor to power each rotor. Steering is accomplished with structure similar to that depicted in U.S. Pat. No. 5,108,220 previously discussed.

Allen U.S. Pat. No. 5,480,257 depicts a twin engine powered riding trowel whose guard structure is equipped with an obstruction clearance system. When troweling areas characterized by projecting hazards such as pipes or ducts, or when it is necessary to trowel hard-to-reach areas adjacent walls or the like, the guard clearance structure may be retracted to apply the blades closer to the target region.

Allen U.S. Pat. No. 5,685,667 depicts a twin engine riding trowel using "contra rotation." For enhanced stability and steering, the rotors rotate in a direction opposite from that normally expected in the art.

U. S. Pat. No. 5,967,696 Oct. 19, 1999 issued to Allen Engineering Corporation depicts a CVT riding trowel, i.e., a trowel with a variable ratio transmission.

Recent patents pertaining to manually steered, dual rotor powered riding trowels include U.S. Pat. Nos. 7,775,740, 8,132,983, and 8,511,934.

With modern power steering designs, the rotors are tilted hydraulically with sophisticated control circuitry that ultimately tilts the rotors for trowel movements as described above. Although hydraulically steered riding trowels may be preferred for many applications, the earlier-developed manually steered riding trowels remain popular. This invention is primarily concerned with manually steered trowels utilizing front levers for steering control.

Relative to hydraulically steered and/or powered trowels, manually steered riding trowels have many advantages, including reduced cost, less complexity, lower weight, higher reliability, and ease of service. Most manually steered trowels position a pair of generally vertically upright primary control steering levers or bars in front of the seated operator. The steering levers have handles grasped by the operator. Each steering lever controls a lower, tilting lever arm extending beneath the frame in a direction generally perpendicular to the biaxial plane. When the primary steering control levers are pulled or pushed, the rotors are tilted to displace the trowel forwardly or backwardly. In most designs, both steering levers may be displaced forwardly or backwardly by pushing or pulling. Commonly at least one of the steering levers may be tilted sideways to produce left or right trowel movements.

With many manually steered trowels, including most prior Allen trowel designs, only one of the steering levers is displaceable sideways, although both can be pushed or pulled. On the other hand, with many competitive manually steered trowel designs, both of the steering levers are movable sideways back and forth. Thus, in the concrete finishing arts, there are two basic riding trowel steering genres. Experienced trowel operators can become accustomed to steering with sideways movements of just one steering lever (i.e., with Allen units), or, alternatively, with sideways movements of both levers.

Most trowel operators prefer the steering characteristics of the type of trowel they first encountered and learned.

Thus it has become apparent to me that manually steered riding trowels should be transformable between the two types of steering characteristics discussed above. Thus when a potential purchaser considers replacing an older, manually steered trowel, a new trowel constructed in accordance with the invention can be easily switched to the desired steering genre, satisfying the preferences of the customer. The transformable steering of the instant invention allows an experienced trowel operator to select the same steering "feel" that he or she has grown to prefer.

SUMMARY OF THE INVENTION

This invention provides a means whereby the steering characteristics of a typical, lever controlled, manually steered riding trowel may be varied in accordance with operator preferences. The invention may be employed with single engine or multiple engine riding trowels using diesel motors, natural gas engines, or traditional gasoline powered motors. The preferred riding trowel comprises one or more engines for powering downwardly projecting rotors whose blades frictionally contact the concrete surface. The rotors are driven by reduction gear boxes that are tilted by parallel levers beneath the machine frame. By tilting the rotors steering and propulsion forces are developed as is well known in the art.

A pair of upright, vertical hand steering levers are deployed in front of the operator. Each may be swiveled beneath the machine frame to be pivoted fore and aft, or left and right. At least one rotor responds to corresponding lateral movements of one or more of the hand steering levers by tilting in an arc perpendicular to the biaxial plane, moving the trowel left or right. In most designs, both rotors can tilt in an arc parallel with or coincident with the biaxial plane, enabling forward or rearward movements.

The trowel may be switched between two different steering configurations, each of which is preferred by diverse users. To emulate prior Allen trowel designs, lateral movements of one of the hand levers is mechanically disabled by connection to the frame. A transformation link semi rigidly connects the hand lever foot to the frame, bracing it and preventing lateral hand steering lever movements. This means that the driver can only swivel a single hand lever towards the left or right, a pattern with which he may be thoroughly familiar from driving prior Allen machines, for example.

The transformation link may be disconnected from the frame and instead connected to the foot of the companion hand steering lever. This means both steering levers are now free to move or pivot laterally, and a different "feel" characterizes steering.

Thus a basic object of my invention is to provide a means whereby the steering genre of a manually steered riding trowel may be switched as desired by an operator.

Another object is to accommodate different trowel user steering habits or preferences.

In other words it is an object of this invention to enable a manually steered riding trowel to be transformed between two major steering types, wherein either one or both of the twin hand steering levers may be moved sideways or laterally during operation.

Another object is to provide an enhanced, switchable lever action for manual trowel steering.

Yet another object is to enable a single manually steered trowel to assume different steering configurations to accommodate the habits or preferences of experienced trowel riders.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

The subject matter of this patent is related to one or more of the following U.S. Pat. No. D323,510 issued January 1992; U.S. Pat. No. 3,936,212 issued February 1976; U.S. Pat. No. 4,046,484 issued Sep. 6, 1977; U.S. Pat. No. 4,312,603 issued Jan. 26, 1982; U.S. Pat. No. 4,556,339 issued Dec. 3, 1985; U.S. Pat. No. 4,676,691 issued Jun. 10, 1987; U.S. Pat. No. 4,710,055 issued Dec. 1, 1987, U.S. Pat. No. 5,108,220 issued Apr. 28, 1992; U.S. Pat. No. 5,238,323 issued Aug. 24, 1993; U.S. Pat. No. 5,405,216 issued Apr. 11, 1995; U.S. Pat. No. 5,480,257 issued Jan. 2, 1996; U.S. Pat. No. 5,480,258 issued Jan. 2, 1996; U.S. Pat. No. 5,613,801 issued Mar. 25, 1997; U.S. Pat. No. 5,658,089 issued Aug. 19, 1997; U.S. Pat. No. 5,685,667 issued Nov. 11, 1997; U.S. Pat. No. 5,803,658 issued Sep. 8, 1998; U.S. Pat. No. 5,934,823 issued Aug. 10, 1999; U.S. Pat. No. 5,988,938 issued Nov. 23, 1999; and, U.S. Pat. No. 6,019,545 issued Feb. 1, 2000. For purposes of disclosure, and compliance with enablement and disclosure requirements of 35 USC Sec. 112 et. Seq., the foregoing patents are hereby incorporated by reference as if fully set forth herein.

Figure 1:
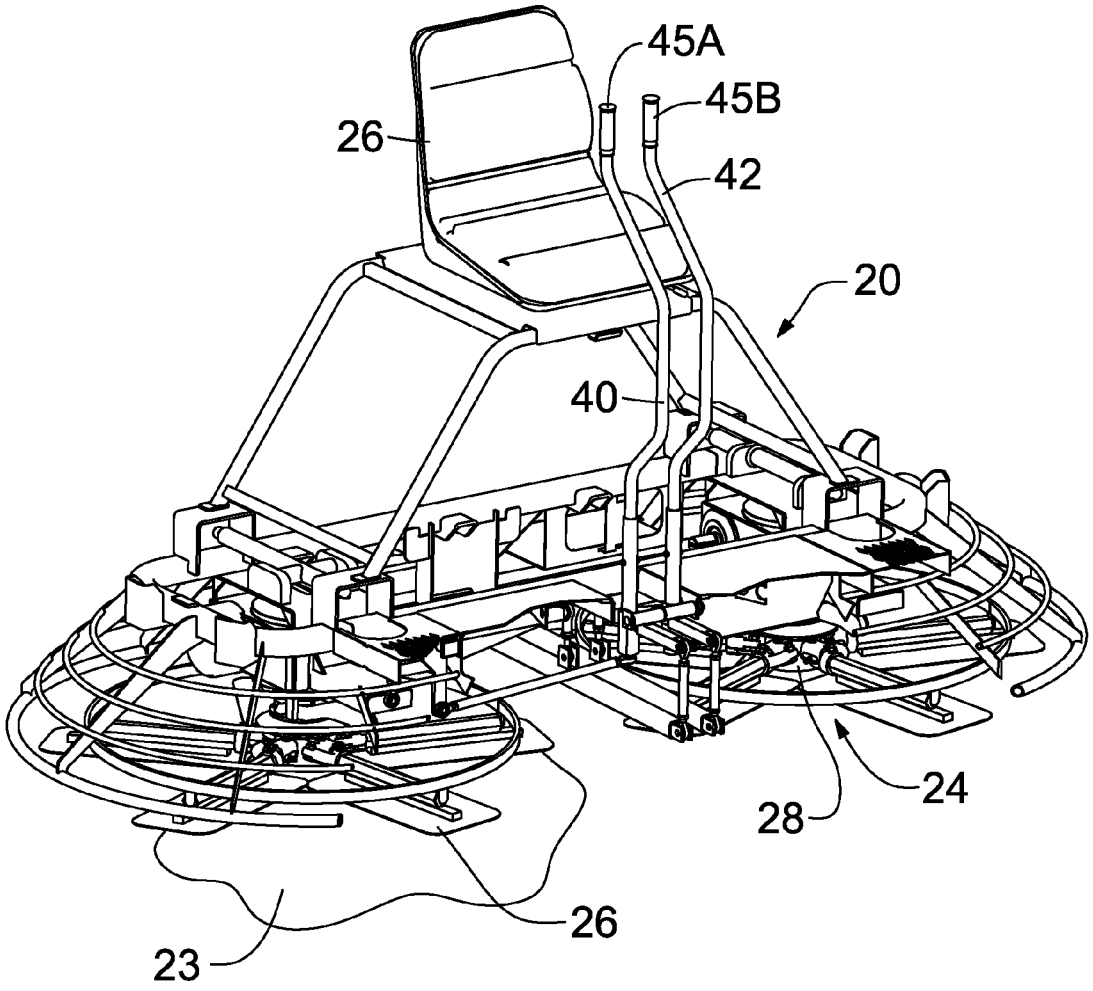
FIG. 1 is a frontal isometric view of a typical motorized, manually steered riding trowel equipped with my new steering system, with portions thereof shown in section or broken away for clarity or omitted for brevity.

FIG. 1 shows a typical dual rotor riding trowel 20 incorporating my new steering linkage modifications. Common structural details relating to riding trowel motors, rotors, steering, rotor tilting, etc. are explained in detail in the above-cited references. It should be appreciated that trowel 20 may comprise diesel, gasoline, or gas powered engines.

The manually steered riding trowel 20 is similar to Allen Engineering manually steered units of the type described, for example, in U.S. Pat. No. 5,108,220. Trowel will include a drive engine (not shown) beneath the seat 26 for powering the downwardly projecting, bladed rotors 24 that frictionally contact the concrete surface 23 below. The multiple, radially spaced apart blades 26 projecting from central hubs 28 are driven by gear boxes known in the art to treat concrete. The manual steering system includes a plurality of linkages, levers, and rods. By tilting the rotors appropriately, directional steering forces are developed.

Steering and handling and propulsion are ultimately effectuated by a pair of vertically upright, primary steering levers 40, 42 that have handle grips 45A, 45B respectively that may be grasped by a user seated in chair 26 (FIG. 1). The manually operated primary steering control levers 40, 42 can both be pushed forwardly or pulled rearwardly (relative to the seated operator) to cause forward or rearward trowel movement respectively. Referencing FIGS. 2-4, each control lever 40, 42 has a lower, transverse, horizontally oriented pivot tube 46, 47 that enable primary lever pivoting relative to an axis formed by bolt 48. Extension arms 50, 51 are controlled by primary hand steering levers 40, 42 respectively. Extension arms 50, 51 respectively depress or lift Heim-joint linkages 54, 55 in response to primary hand lever forward or backward movements. Each linkage 54, 55 comprises Heim joints at each of its ends for flexibility. Linkages 54, 55 respectively lift or lower the substantially horizontal, rearwardly extending gearbox tilting levers 56 and 58, which tilt the rotor gearboxes and rotors to move the machine forwardly or rearwardly, as is known in the art. Thus tilt levers 56 and 58 respond to the hand steering levers 40, 42 and tilt the rotors in a plane parallel to or coincident with the aforesaid biaxial plane. It is typical for both rotors to pivot within or parallel to the biaxial plane to effectuate forward or reverse movement.

Figure 5:
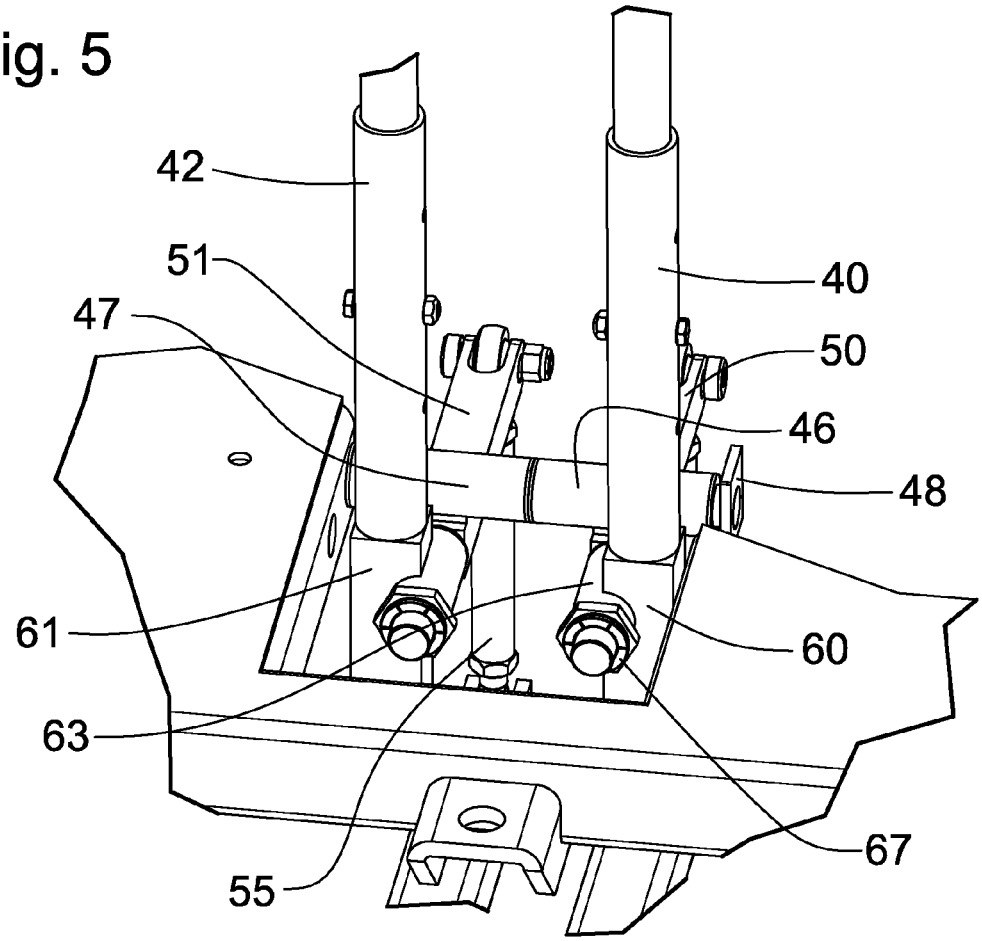
FIG. 5 is an enlarged, fragmentary rear isometric view taken generally along line 5-5 in FIG. 4 showing the pivoting apparatus; and, FIG. 6 is an enlarged, isometric view of a preferred extension arm.
Figure 6:
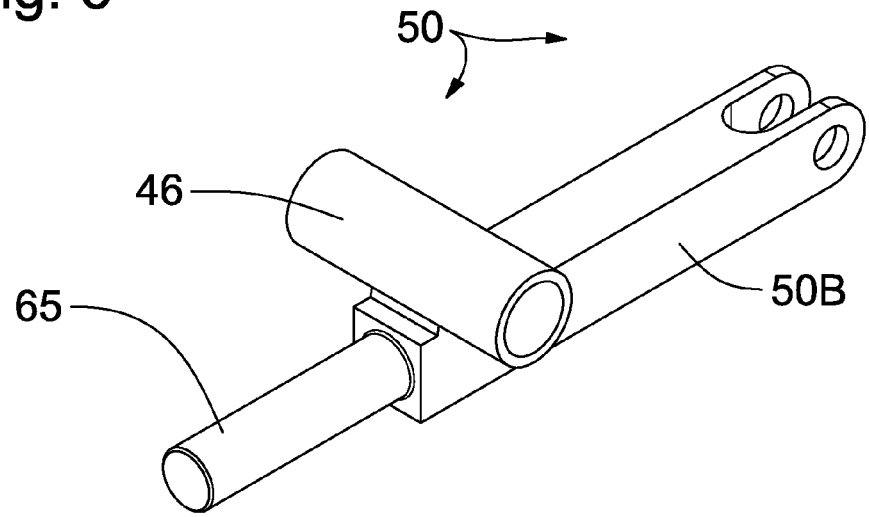

However, it is usually the case that only one rotor tilts in an arc perpendicular to the biaxial plane. As is known in the art, hand steering lever 40 (i.e., FIG. 3) can also swivel in response to hand movements to the left or right, causing corresponding trowel movements, by perpendicular tilting of the corresponding rotor. As illustrated, both hand steering levers 40, 42 are preferably capable of swiveling to the left or right, as hereinafter clarified. Hand lever 40 terminates in its bottom in a hollow, sleeve-like foot 60 (FIGS. 4, 5) that includes a transverse foot sleeve 63, to which it is welded. The rears of the extension arms 50, 51 discussed above are configured to pivotally capture the feet 60, 61 by engagement with foot sleeve portions 63. Noting FIGS. 5 and 6, each extension arm 50 (or 51) comprises a horizontal portion 50B visible in FIG. 6, to which a transversely-oriented pivot tube 46 (or 47) is welded. Each extension arm 50, 51 comprises a rearwardly projecting, threaded stub 65 which penetrates and pivots a foot sleeve 63, as best seen in FIG. 5. In assembly, a threaded nut 67 (FIG. 5) maintains a foot sleeve 63 coaxially over an extension arm stub 65 (FIG. 6).

Figure 2:
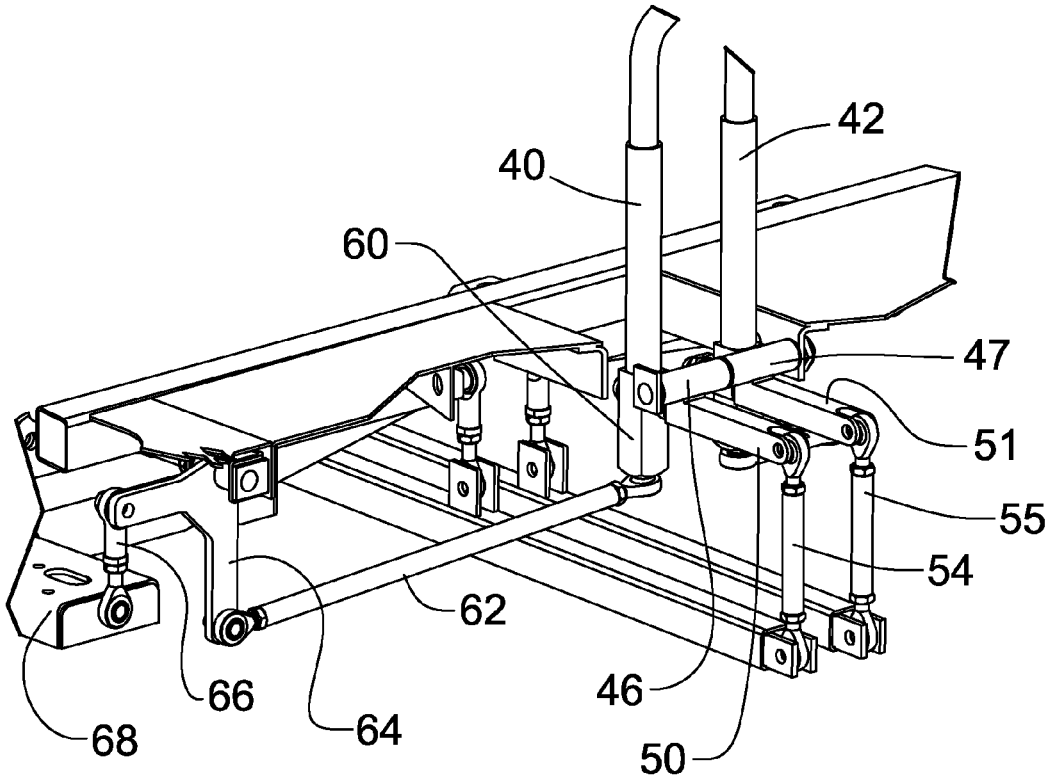
FIG. 2 is a fragmentary isometric view of the trowel of FIG. 1, with portions thereof shown in section or broken away for clarity or omitted for brevity.

When hand lever 40 is moved to the left or right by the operator, the bottom foot 60 (FIGS. 2, 3) laterally displaces the tilting rod 62 (i.e., FIG. 4) to at least partially rotate crank 64 (FIG. 2). A Heim connector 66 (FIG. 2) driven by crank 64 thus tilts one rotor in an arc perpendicular to the biaxial plane. This tilting action causes the trowel to move left or right as is known in the art.

Figure 3:
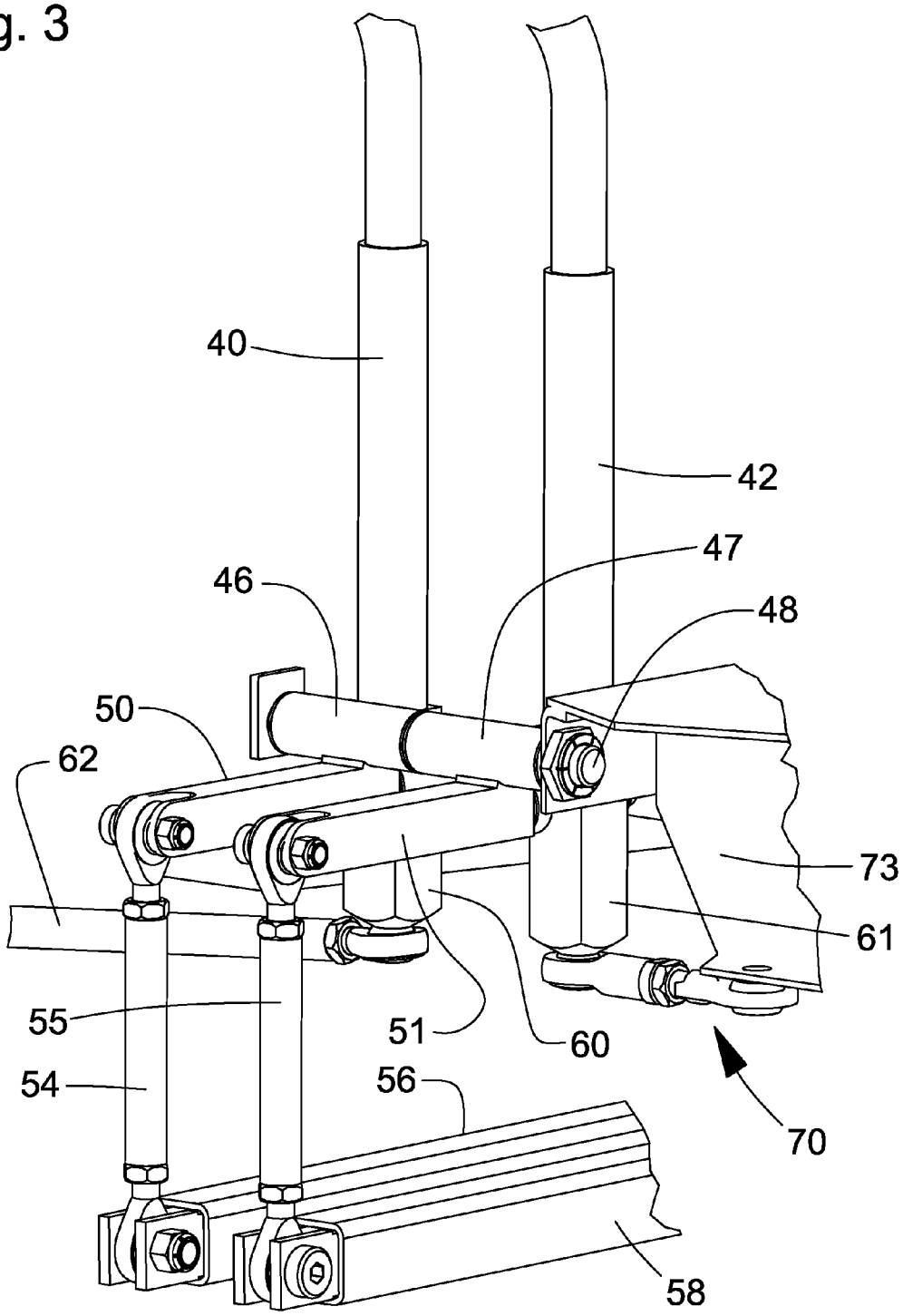
FIG. 3 is an enlarged, fragmentary, isometric view of preferred steering linkage parts as they are arranged when sideways movements of both steering levers are to be enabled.

The invention enables a user to allow either one or both primary steering levers 40 and/or 42 to be swiveled or pivoted left or right. Noting FIG. 3, hand steering lever 42 may be designed like lever 40 to optionally be able to pivot left or right. However, in FIG. 3, the lower foot 61 of primary steering lever 42 is semi-rigidly connected to the machine frame portion 73 by a transformation link 70. In FIG. 3, transformation link 70, which comprises a Heim joint at each end, thus connects between lever 42 and the machine frame at 73, to suppress possible lateral movements of primary steering lever 42. In this configuration (i.e., FIG. 3) the trowel only enables left or right tilting of a single hand steering lever 40, and lever 42 will not be movable left or right. The latter situation is characteristic of a wide variety of prior art Allen Engineering Corporation manual trowels, and several machines by other manufacturers. This steering characteristic generates a unique "feel" or "touch" over time by trowel drivers that learn to prefer the Allen Engineering steering style and become accustomed to it.

However, several manufacturers prefer that both hand steering levers in manual machines be able to tilt left and/or right. This too eventually generates a unique "feel" or "touch" by trowel drivers of such machines over time. Accordingly, trowel 20 may be adjusted to achieve the aforementioned "feel" of a machine whose hand steering levers both tilt left and right.

Figure 4:
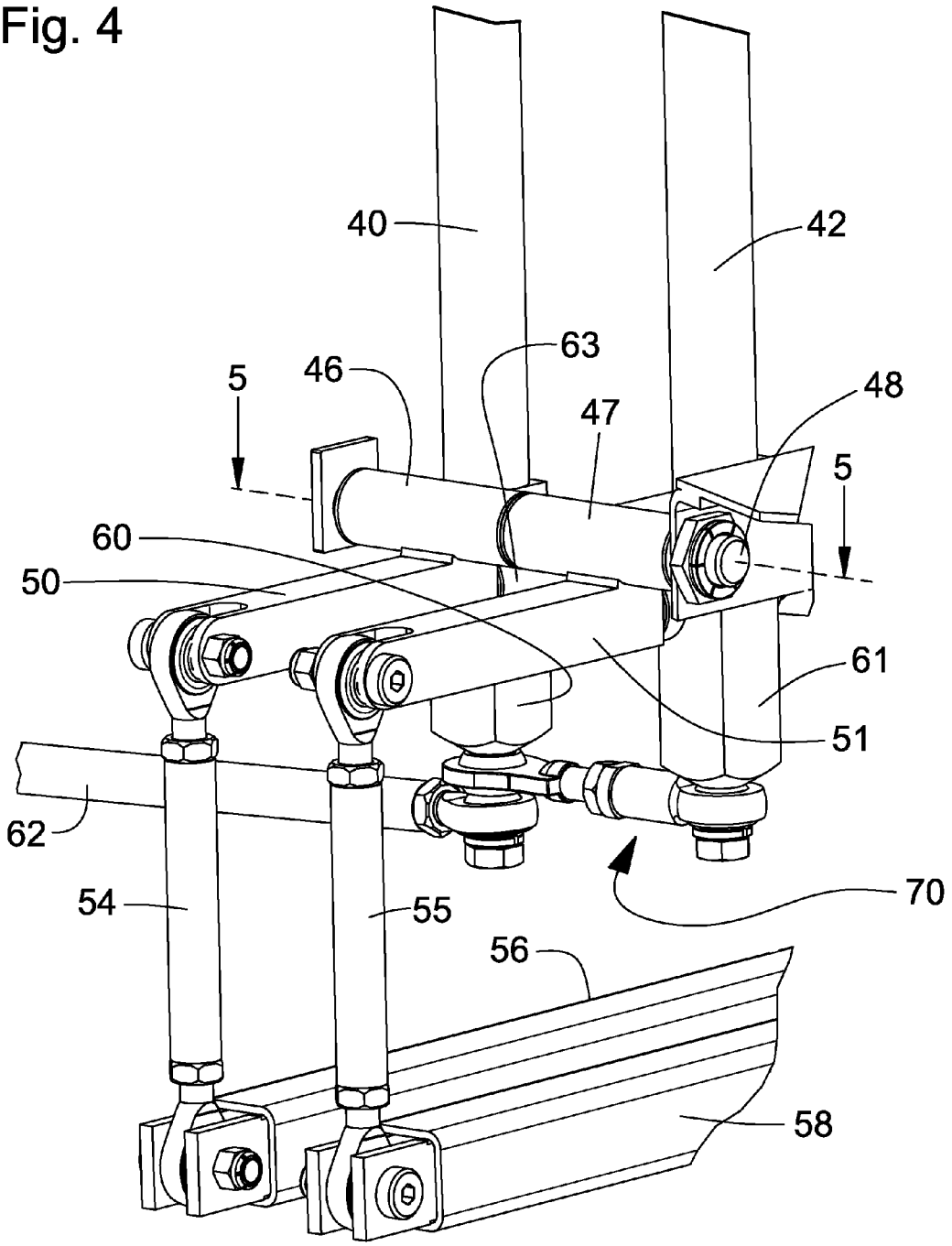
FIG. 4 is an enlarged, fragmentary, isometric view of preferred steering parts, as they are arranged when sideways displacement of only one steering lever is to be enabled, with portions thereof shown in section or broken away for clarity or omitted for brevity.

It will be noted in FIG. 4 that the transformation link 70 is no longer connected to the trowel frame. Hand steering lever 42 is thus now freed to pivot laterally. However, transformation link 70 now interconnects the bottom feet 60, 61 of the steering levers 40, 42 respectively. Thus, in the configuration of FIG. 4, the hand levers 40, 42 may both be pivoted laterally together to produce deflections of tilting rod 62 (FIG. 2) and concomitant arcing of a rotor perpendicular to the biaxial plane. In the best mode, only one rotor is tilted in an arc perpendicular to the biaxial plane so tilting rod 62 does not have a companion on the opposite side.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations.

As many possible embodiments may be made of the invention without departing from the scope thereof, it is to be understood that all matter herein set forth or shown in the accompanying drawings is to be interpreted as illustrative and not in a limiting sense.

What is claimed is:

1. A manually steered riding trowel comprising;

a frame;

engine means secured to said frame for powering the trowel;

a pair of downwardly projecting, pivoted rotors that frictionally contact concrete;

a pair of steering levers that may be grasped by a user and pushed forwardly or pulled rearwardly to tilt at least one of said rotors and cause forward or rearward trowel movement;

at least one of said steering levers adapted to be moved laterally side to side to tilt at least one rotor to cause lateral trowel movement; and, a transformation link adapted to be connected between said steering levers thereby enabling both steering levers to move laterally together, said transformation link adapted to be selectively disconnected from one of said steering levers while remaining connected to the other of said steering levers and connected to the trowel frame to suppress lateral movements of the other of said steering levers.

2. The trowel as defined in claim 1 wherein:

the trowel comprises a pair of extension arms beneath the steering levers, each extension arm comprising a transversely oriented pivot tube and an rearwardly projecting stub; and, each steering control lever comprises a lower foot with a foot sleeve adapted to pivotally receive said stub to enable lateral pivoting of at least one steering lever.

3. A manually steered riding trowel comprising;

a frame;

engine means secured to said frame for powering the trowel;

a pair of downwardly projecting, pivoted rotors that frictionally contact concrete;

a pair of steering levers that may be grasped by a user and pushed forwardly or pulled rearwardly to tilt at least one of said rotors and cause forward or rearward trowel movement;

at least one of said steering levers adapted to be moved laterally side to side to tilt at least one rotor to cause lateral trowel movements; and, a transformation link adapted to be switched between first and second configurations, wherein:

(a) in the first configuration the transformation link connects one steering lever to the other steering lever to enable both steering levers to move laterally together; and, (b) in the second configuration the transformation link connects one steering lever to the machine frame to prevent that steering lever from moving laterally.

4. The trowel as defined in claim 3 wherein:

the trowel comprises a pair of extension arms beneath the steering levers, each extension arm comprising a transversely oriented pivot tube and an rearwardly projecting stub; and, each steering lever comprises a lower foot with a foot sleeve adapted to pivotally receive said stub to enable lateral pivoting of at least one steering lever.

5. A manually steered riding trowel comprising;

a frame;

engine means secured to said frame for powering the trowel;

a pair of pivoted rotors projecting downwardly from the frame that frictionally contact concrete;

first and second steering levers that may be grasped by a user and pushed forwardly or pulled rearwardly to tilt at least one of said rotors and cause forward or rearward trowel movement;

wherein said first steering lever is adapted to be moved laterally side to side to tilt at least one rotor to cause lateral trowel movement; and, a transformation link connected at one end to said second steering lever and at an opposite end to the trowel frame to suppress lateral movements of said second steering lever, wherein the transformation link opposite end can alternatively be disconnected from said frame and connected to said first steering lever to enable both steering levers to move laterally together.

* * * * *